US008844919B2

(12) United States Patent
Motoyoshi

(10) Patent No.: US 8,844,919 B2
(45) Date of Patent: Sep. 30, 2014

(54) SQUARE BACK PROCESSING WITH VARIABLE NIPPING

(71) Applicant: Tomoya Motoyoshi, Kanagawa (JP)

(72) Inventor: Tomoya Motoyoshi, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/680,485

(22) Filed: Nov. 19, 2012

(65) Prior Publication Data

US 2013/0127106 A1 May 23, 2013

(30) Foreign Application Priority Data

Nov. 22, 2011 (JP) ..... 2011-254716

(51) Int. Cl.

| | |
|---|---|
| ***B65H 37/06*** | (2006.01) |
| ***B65H 39/00*** | (2006.01) |
| ***B65H 45/30*** | (2006.01) |
| ***B65H 45/18*** | (2006.01) |

(52) U.S. Cl.

CPC ..... *B65H 39/00* (2013.01); *B65H 2511/224* (2013.01); *B65H 2511/222* (2013.01); *B65H 270/13212* (2013.01); *B65H 45/30* (2013.01); *B65H 45/18* (2013.01)

USPC ..... 270/37; 270/32; 493/444; 493/445

(58) Field of Classification Search

USPC ..... 270/32, 37, 39.06, 39.07, 39.08, 45; 493/444, 445

See application file for complete search history.

(56) References Cited

U.S. PATENT DOCUMENTS

| | | | | |
|---|---|---|---|---|
| 4,592,651 | A * | 6/1986 | Oikawa et al. | 355/72 |
| 6,817,605 | B1 * | 11/2004 | Bohn | 270/37 |
| 6,929,256 | B2 * | 8/2005 | Kawatsu et al. | 270/37 |
| 7,325,799 | B2 * | 2/2008 | Watkiss | 270/39.08 |
| 7,594,645 | B2 * | 9/2009 | Suzuki et al. | 270/37 |
| 7,660,556 | B2 * | 2/2010 | Saitsu et al. | 399/407 |
| 7,976,450 | B2 * | 7/2011 | Endo | 493/407 |
| 2006/0153612 | A1 * | 7/2006 | Saitsu et al. | 399/410 |
| 2013/0038012 | A1 * | 2/2013 | Kasuga et al. | 270/32 |

FOREIGN PATENT DOCUMENTS

| | | |
|---|---|---|
| JP | 05-024738 | 2/1993 |
| JP | 2006-219296 | 8/2006 |
| JP | 2009-120398 | 6/2009 |
| JP | 2011-026125 | 2/2011 |
| JP | 2011-102189 | 5/2011 |
| JP | 2011-156828 | 8/2011 |

OTHER PUBLICATIONS

Jspanese Office Action and English translation, Japan Patent Application No. 2011-254716, shipping day: Nov. 5, 2014 (4 pages).

* cited by examiner

*Primary Examiner* — Patrick Mackey
(74) *Attorney, Agent, or Firm* — Lucas & Mercanti, LLP

(57) ABSTRACT

A post-processing apparatus includes a folding section configured to nip a sheet using a plurality of rollers to form a fold line for saddle stitching and a control section to control the nipping amount in the folding section. When carrying out square back processing to flatten the spine folded portion of a sheet bundle where a fold line for saddle stitching is formed, the post-processing apparatus allows the nipping amount in the folding section to be smaller than that in the case where the square back processing is not carried out.

20 Claims, 12 Drawing Sheets

SQUARE BACK PROCESSING WITH VARIABLE NIPPING

This application claims the priority of Japanese Patent Application JP2011-254716 filed Nov. 22, 2011, and is incorporated by reference herein.

BACKGROUND OF THE INVENTION

1. Field of the Invention

The present invention relates to a post-processing apparatus and a post-processing method to form a fold line for saddle stitching in a sheet on which an image is formed.

2. Description of Related Art

When an image forming apparatus is connected to various types of post-processing apparatuses, various bookbinding processings can be realized, and thereby such an apparatus can be used as a printing apparatus.

For example, as shown in FIG. 18, a sheet is center-folded at the center a1 thereof and then this sheet is collected on a plural sheet basis to obtain a sheet bundle. Then, the fold line portion of the center a1 of this sheet bundle is stapled (ST of FIG. 18) and thereby saddle stitching bookbinding can be carried out.

Further, as shown in FIG. 19, the spine portion of a saddle-stitched sheet bundle is pressed with a roller and fold lines with corners b1 and b2 are made to produce a spine cover portion. Such operations make it possible to carry out square back processing allowing a sheet bundle to be in a state similar to perfect binding.

Incidentally, such saddle stitching and square back processing are proposed in Unexamined Japanese Laid-Open Patent Application No. 2009-120398.

In Japanese Laid-Open Patent Application No. 2009-120398 described above, the spine folded portion of the center of a sheet is nipped by rollers from both sides to carry out center folding for saddle stitching. In this case, the nipping pressures of the rollers are changed depending on execution or no execution of square back processing to carry out square bad processing favorably.

However, since such square back processing is carried out after saddle stitching, as shown in FIG. 20, a center folding trace a3 during saddle stitching remains in a portion of the spine cover. Therefore, in the square back processing, the quality as a booklet has been found to degrade.

Further, in the case where an image is formed on the spine cover portion, it has been found that a center folding trace (a3 in FIG. 20) deteriorates the image of the spine cover portion.

However, this square back processing presupposes saddle stitching. Therefore, if no center folding has been carried out, in conveyance from a folding section to a slacking section and a saddle stitching section and in positioning in the stacking section and the saddle stitching section, a new problem, in which stitching position accuracy is difficult to maintain, is posed.

SUMMARY OF THE INVENTION

The post-processing apparatus includes:

a folding section configured to nip a sheet using a plurality of rollers to form a fold line for saddle stitching; and a control section configured to control the nipping amount in the folding section, the nipping amount in the folding section in the case where square back processing to flatten a spine folded portion of a sheet bundle on which a fold line for saddle stitching is formed is executed being smaller than that in the case where the square back processing is not executed.

In the above post-processing, it is preferable that the folding section nip the sheet using the plurality of rollers while inserting a knife from the rear of a portion where a fold line of the sheet is formed; and the control section change the insertion amount of the knife depending on whether the square back processing is executed to control the nipping amount in the folding section.

In the post-processing apparatus, it is preferable that the control section perform a control operation to change the nipping amount in the folding section with respect to at least a sheet to serve as the cover in a sheet bundle to be subjected to square back processing.

In the post-processing apparatus, it is preferable that the control section determine whether a control operation is performed to change the nipping amount in the folding section based on the type of the sheet when the square back processing is performed.

In the post-processing apparatus, it is preferable that the control section determine whether a control operation is performed to change the nipping amount in the folding section depending on whether an image is formed on a spine cover portion to be flattened in a sheet to serve as a cover when the square back processing is executed.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 10 is a constitutional view illustrating the configuration of the post-processing apparatus of the embodiment of the present invention;

FIG. 12 is a time chart showing operations of the post-processing apparatus of the embodiment of the present invention;

FIG. 13 is a time chart showing operations of the post-processing apparatus of the embodiment of the present invention;

FIG. 14 is an illustration view illustrating an operational state of the reverse conveyance apparatus of the embodiment of the present invention;

FIG. 15 is an illustration view illustrating an operational state of the reverse conveyance apparatus of the embodiment of the present invention;

FIG. 16 is an illustration view illustrating an operational state of the reverse conveyance apparatus of the embodiment of the present invention;

FIG. 17 is an illustration view illustrating an operational state of the reverse conveyance apparatus of the embodiment of the present invention;

FIG. 18 is an illustration view illustrating a state of a conventional saddle stitching;

FIG. 19 is an illustration view illustrating a state of the conventional square back processing.

DETAILED DESCRIPTION OF THE INVENTION

With reference to the drawings, a mode for carrying out the present invention (hereinafter, referred to as an embodiment) will now be described in detail.

Configuration of an Image Forming System

Figure 1:
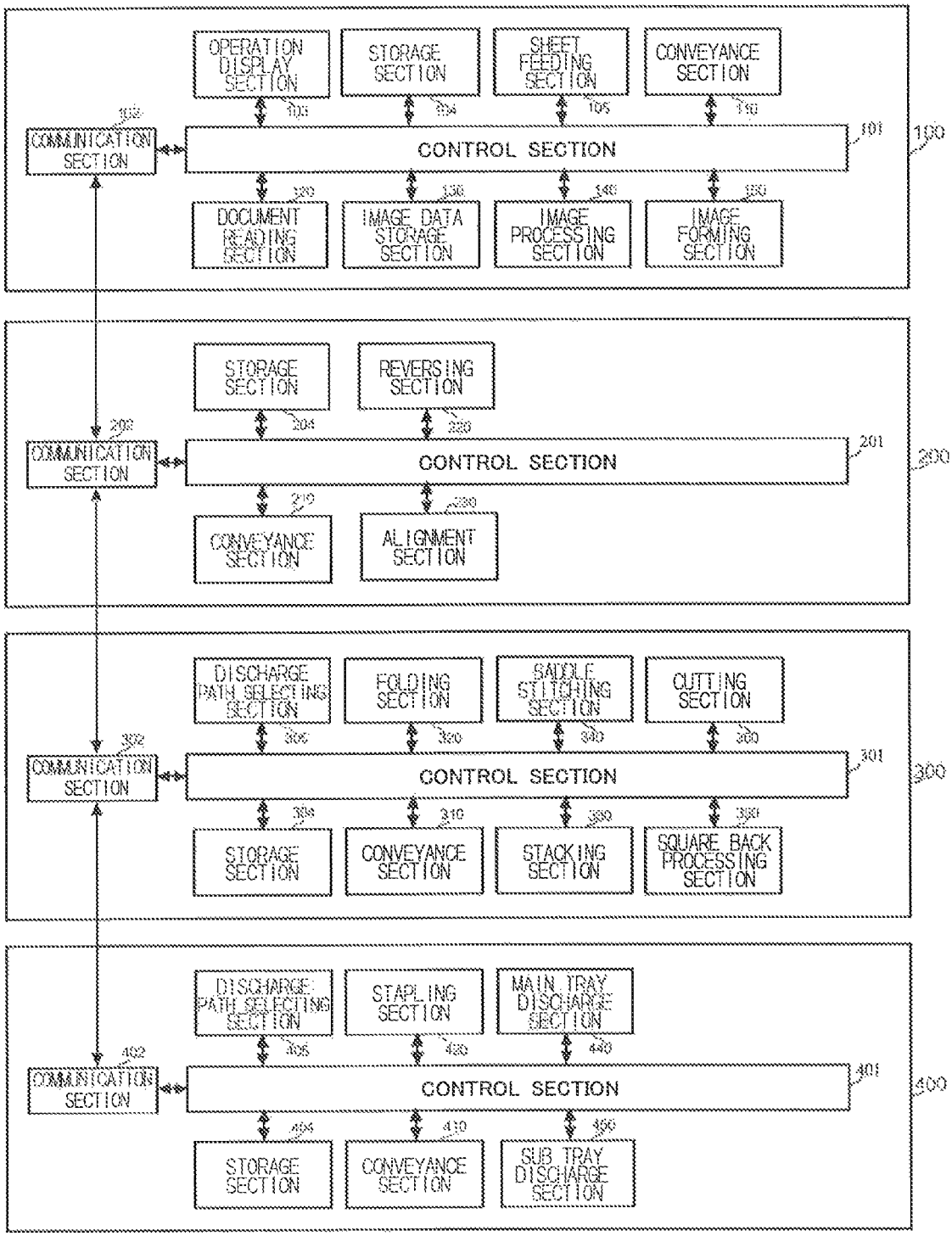
FIG. 1 is a block diagram illustrating the configuration of a post-processing apparatus of an embodiment of the present invention.
Figure 2:
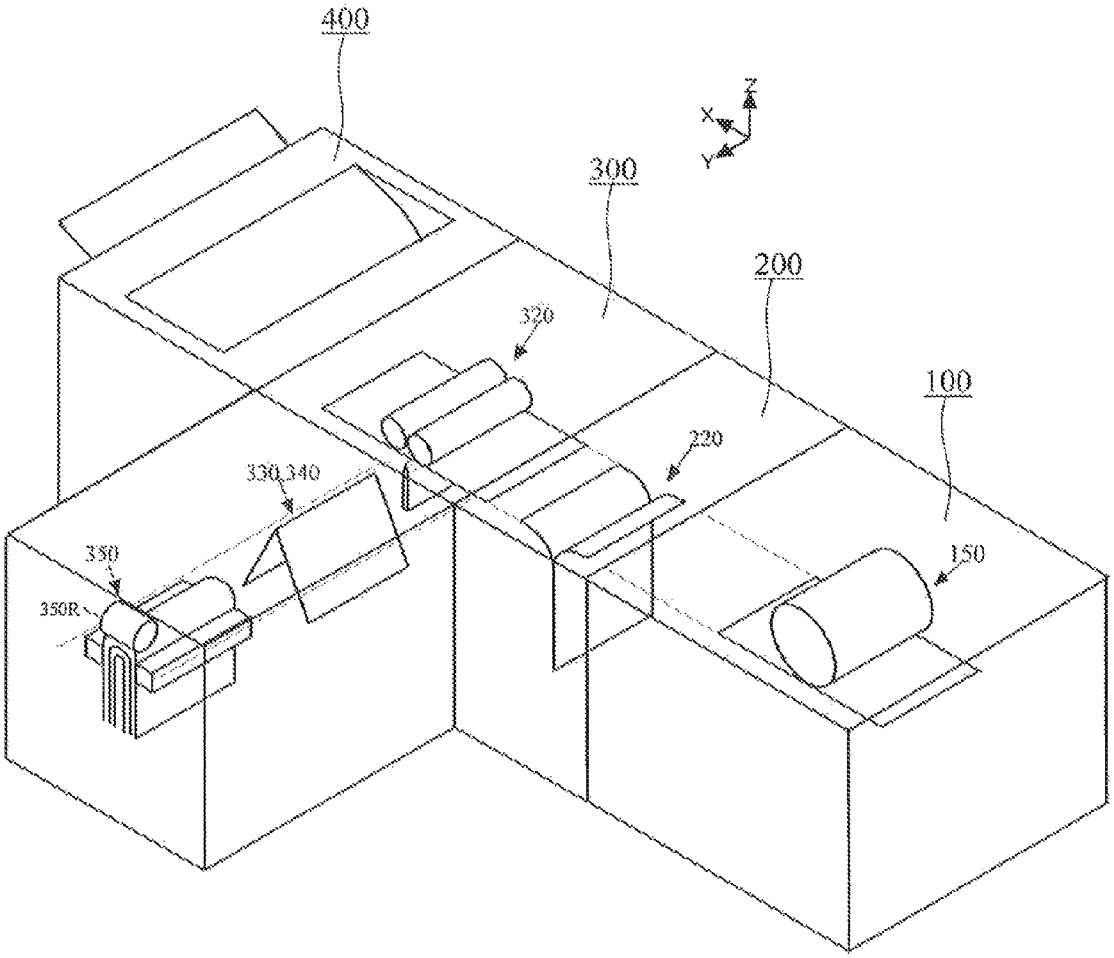
FIG. 2 is a constitutional view illustrating the configuration of the post-processing apparatus of the embodiment of the present invention.

With reference to FIG. 1 and FIG. 2, the configuration of an image forming system including a post-processing apparatus according to the present embodiment will be described below. As shown in FIG. 1 and FIG. 2, this image forming system includes an image forming apparatus 100, a reverse conveyance apparatus 200, a post-processing apparatus 300, and a post-processing apparatus 400.

The image forming apparatus 100 is configured by including a control section 101 to control. each section in the image forming apparatus 100 and also the entire system as the post-processing apparatus; a communication section 102 to communicate with other connected apparatuses; an operation display section 103 to inform the control section 101 of an operation input signal based on an operation input by the operator and also to display the state of the image forming apparatus 100; a storage section 104 to store a control program and various kinds of setting data and also to be used as a work area of the control program; a sheet feeding section 105 to feed accommodated sheets; a conveyance section 110 to convey, at a predetermined rate, a sheet to be fed and subjected to image formation; a document reading section 120 to scan an original document to generate image data; a storage section 130 to store image data during image formation and various kinds of data; an image processing section 140 to carry out various types of image processings required for image formation; and an image forming section 150 to carry out image formation (printing) based on image formation instructions and image data. Herein, a sheet where an image has been formed by the image forming apparatus 100 is discharged toward the following reverse conveyance apparatus 200.

The reverse conveyance apparatus 200 is connected posteriorly to the image forming apparatus 100 and is configured by including a control section 201 to control each section in the reverse conveyance apparatus 200; a communication section 202 to communicate with the image forming apparatus 100 and the post-processing apparatus 300; a storage section 204 to store a control program and various kinds of setting data and also to be used as a work area of the control program; a conveyance section 210 to convey a sheet at a predetermined rate; a reversing section 220 to reverse a sheet from the image forming apparatus 100; and an alignment section 230 to align a reversed sheet.

The post-processing apparatus 300 is connected posteriorly to the reverse conveyance section 200 and is configured by including a control section 301 to control each section in the post-processing apparatus 300; a communication section 302 to communicate with the image forming apparatus 100 and the reverse conveyance section 200; a storage section 304 to store a control program and various kinds of setting data and also to be used as a work area of the control program; a discharge path selecting section 305 to select a discharge path to discharge a post-processed sheet bundle; a conveyance section 310 to convey a sheet at a predetermined rate; a folding section 320 to center-fold or tri-fold a sheet; a stacking section 330 to stack sheets for post-processing to give a sheet bundle; a saddle stitching section 340 to saddle-stitch by stapling, as post-processing, sheets folded by the folding section 320; a square back processing section 350 to carry out square back processing to flatten the spine folded portion of a sheet bundle in which a fold line for saddle stitching is formed; and a cutting section 360 to cut the fore-edge portion of a saddle-stitched sheet bundle.

The post-processing apparatus 400 is connected posteriorly to the post-processing apparatus 300 and is configured by including a control section 401 to control each section in the post-processing apparatus 400; a communication section 402 to communicate with the image forming apparatus 100 and the post-processing section 300; a storage section 404 to store a control program and various kinds of setting data and also to be used as a work area of the control program; a discharge path selecting section 405 to select a discharge path to discharge a post-processed sheet bundle; a conveyance section 410 to convey a sheet at a predetermined rate; a stapling section 420 to staple a sheet bundle; a main tray discharge section 440 to discharge a sheet to a main tray as the discharge destination; and a sub tray discharge section 450 to discharge a sheet to a sub tray as the discharge destination.

Incidentally, when a sheet having been conveyed from the image forming apparatus 100 in the X direction of FIG. 2 is post-processed by the post-processing apparatus 400, the sheet is post-processed while being conveyed in the X direction as is to be discharged.

In contrast, in the case of carrying out post-processing in the post-processing apparatus 300, as shown in FIG. 2, center folding is carried out in the Y direction as the ridge line in the folding section 320, and then with conveyance in the Y direction, as stacking is performed in the stacking section 330 and the saddle-stitching section 340, saddle-stitching is carried out. Further, saddle-stitched sheets are conveyed in the Y direction and then using the square hack processing section 350, a portion of the spine cover is subjected to square back processing to be flattened by a roller 350R, whereby the execution efficiency of post-processing is increased and then the productivity as the image forming system can be enhanced.

Further, the connection among the image forming apparatus 100, the reverse conveyance apparatus 200, the post-processing apparatus 300, and the post-processing apparatus 400 is merely one example of the image forming system, which is not limited to this connection.

Figure 3:
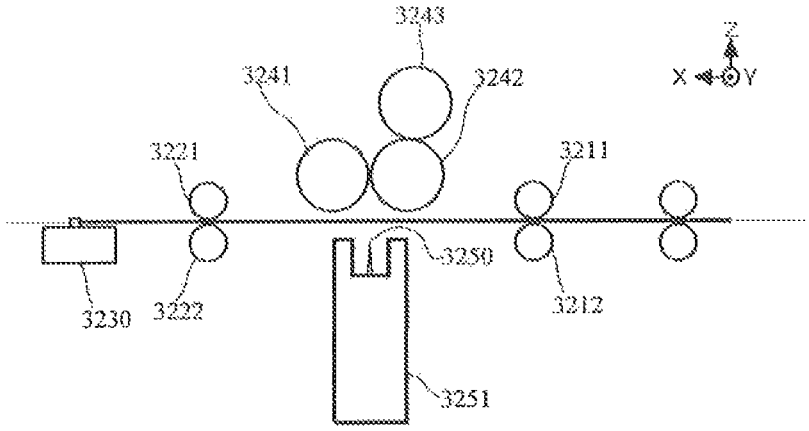
FIG. 3 is a constitutional view illustrating the configuration of the main part of the post-processing apparatus of the embodiment of the present invention.
Figure 4:
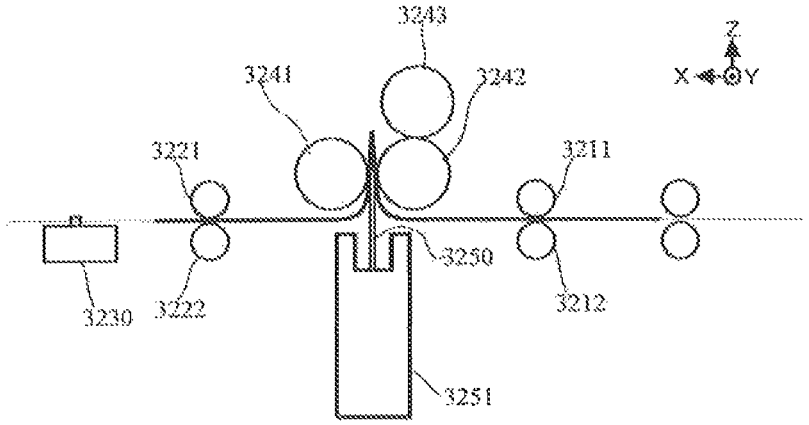
FIG. 4 is a constitutional view illustrating the configuration of the main part of the post-processing apparatus of the embodiment of the present invention.

FIG. 3 and FIG. 4 are sectional constitution views illustrating, in the XZ plane, the basic configuration of the folding section 320 in the post-processing apparatus 300. Herein, a sheet conveyed from the image forming apparatus 100 and the reverse conveyance apparatus 200 to the folding section 320 is conveyed inside the folding section 320 at a predetermined rate via a conveyance roller 3211 and a conveyance roller 3212, and a conveyance roller 3221 and a conveyance roller 3222.

Then, when folding is carried out in the folding section 320, using a front edge stopper 3230, a sheet is stopped while being regulated at a predetermined position (FIG. 3). Thereafter, a knife 3250 driven by a knife drive section 3251 is extended in the Z direction between folding rollers 3241 and 3242 and thereby a sheet is nipped between the folding rollers 3241 and 3242 to form a fold line (FIG. 4).

At that time, the folding rollers 3241 and 3242 are being allowed to freely rotate and then stopped after elevation of the knife 3250 by a certain time set by a timer. Then, the drive roller 3243 drives the folding roller 3242 in the direction where the sheet and the knife 3250 return. In addition, this folding section 320 can carry out center folding to form a fold line in the center of a sheet for saddle stitching as well as tri-folding to form a fold line in 2 locations of a sheet.

Operations

With reference to the flowcharts and various types of illustration views in FIG. 5 and the following figures, operations of the present embodiment will now be described. Herein, the post-processing apparatus 300 in the image forming system with the connected state of FIG. 1 and FIG. 2 will be taken as a specific example.

Figure 5:
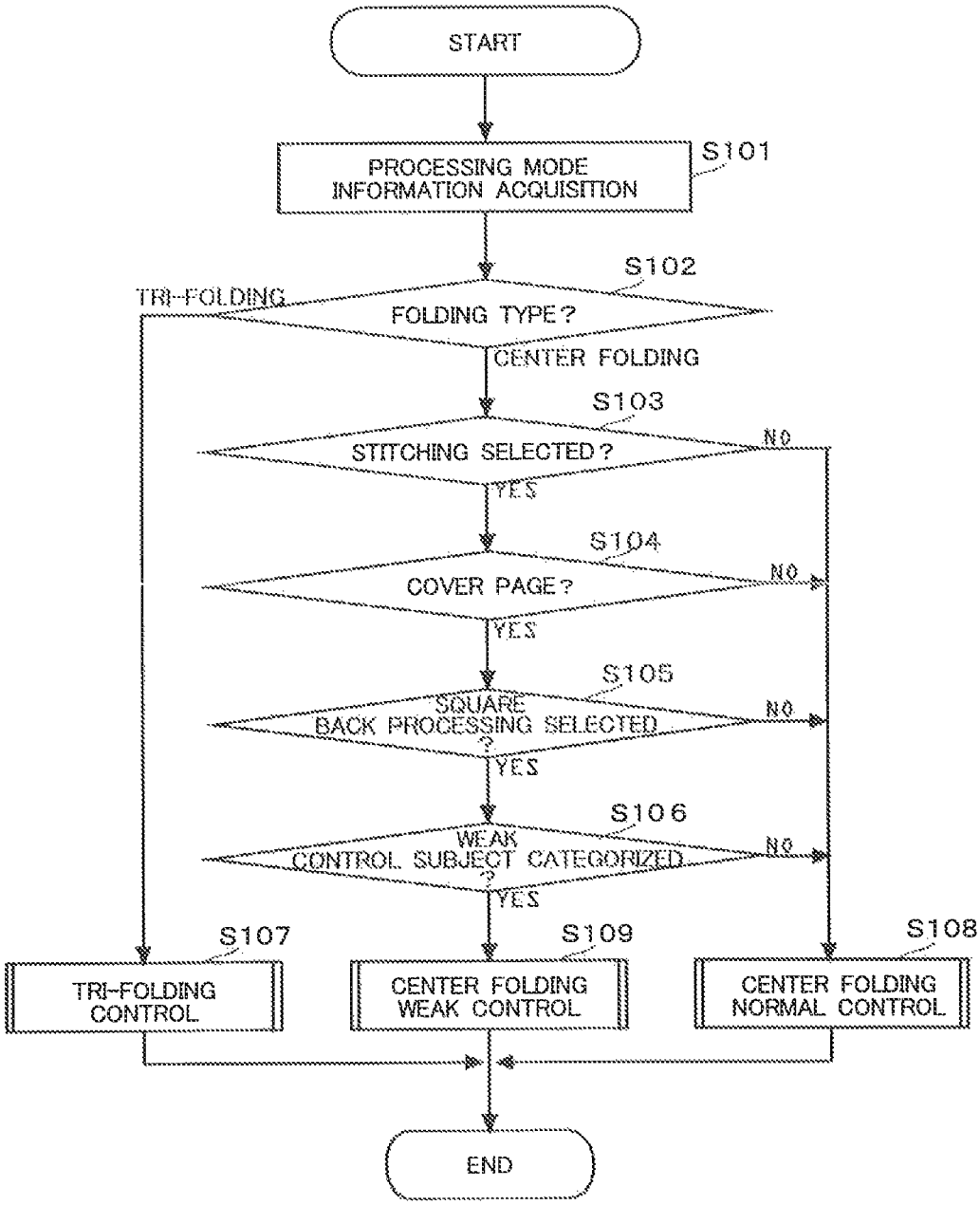
FIG. 5 is a flowchart showing operations of the post-processing apparatus of the embodiment of the present invention.

With the start of image formation, the control section 301 of the post-processing apparatus 300 requests post-processing mode information as information relevant to a processing mode with respect to post-processing from the control section 101 (step S141 in FIG. 5).

Herein, the post-processing apparatus 300 requests items of post-processing mode information relevant to folding, saddle stitching, and square back processing. Therefor, the control section 101 informs the control section 301 of post-processing mode information relevant to the post-processing apparatus 300 from job information.

This post-processing mode information contains items of information such as the type of folding, selection or no selection of stitching, selection or no selection of square back processing, the paper type of the cover, the presence or absence of an spine cover image, and whether or not a sheet discharged from the image forming apparatus 100 is a cover.

Figure 6:
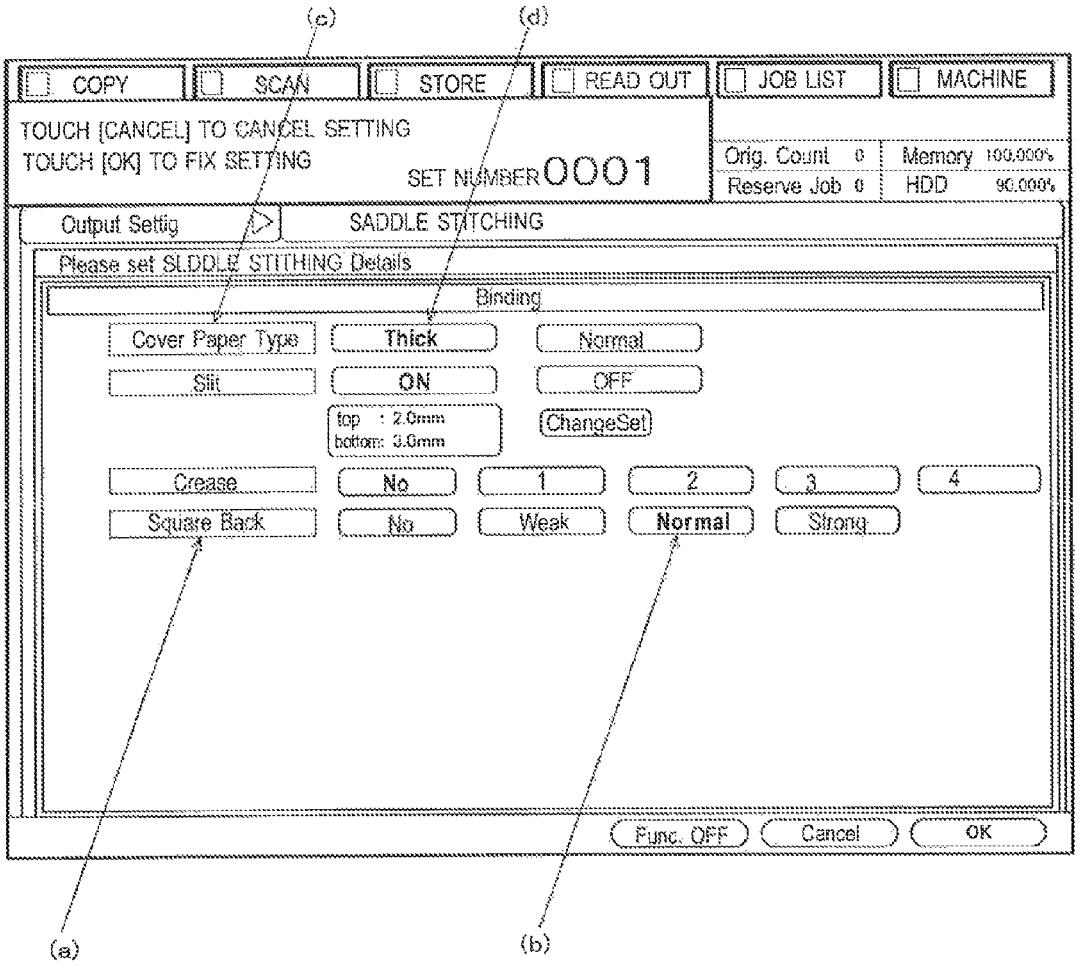
FIG. 6 is an illustration view illustrating an operational state of a reverse conveyance apparatus of the embodiment of the present invention.

Incidentally, prior to the start of image formation, in the operation display section 103 of the image forming apparatus 100 or in the operation screen of an external PC not shown using a screen as shown in FIG. 6, setting with respect to saddle stitching has been carried out. In this operation screen, square back processing (region (a) in FIG. 6) has been set as "normal state execution" (region (b) in FIG. 6) and the paper type of the cover (region (c) in FIG. 6) has been designated as thick paper (region (d) in FIG. 6). Further, in another job setting screen not shown, the execution or no execution of image formation for a portion to be formed as a spine cover via square back processing and the contents of an image are set.

The control section 301 having received the post-processing mode information from the control section 101 judges whether the type of folding is "tri-folding" or "center folding" with respect to executed image formation (step S102 in FIG. 5).

Herein, when the type of folding with respect to the executed image formation is "tri-folding" ("tri-folding" at step S102 in FIG. 5), the control section 301 provides instructions on tri-folding to the folding section 320, which then performs a tri-folding control operation to tri-fold a sheet (step S107 in FIG. 5).

Incidentally, since this tri-folding control operation is a well-known control operation in which the folding section 320 folds a sheet via a folding method such as inner tri-folding or outer tri-folding (Z-folding), detailed description will be omitted.

On the other hand, when the type of folding with respect to the executed image formation is "center folding" ("center folding" at step S102 in FIG. 5), the control section 301 judges whether center folding is accompanied by saddle stitching (step S103 in FIG. 5). Herein, in the case of center folding, however, without saddle stitching (NO at step S103 in FIG. 5), the control section 301 provides instructions on center folding normal control to the folding section 320, which then performs a normal center folding control operation to center-fold a sheet (step S108 in FIG. 5).

Further, when the type of folding is center folding with saddle stitching with respect to executed image formation (YES at step S103 in FIG. 5), the control section 301 judges whether each sheet is a cover (step S104 in FIG. 5).

Herein, in the case of saddle stitching, when a sheet is, however, other than the cover (NO at step S104 in FIG. 5), the control section 301 provides instructions on center folding normal control to the folding section 320, which then performs a normal center folding control operation to center-fold a sheet (step S108 in FIG. 5). Further, the control section 301 provides instructions on saddle stitching control to the saddle stitching section 340, which then performs a saddle stitching control operation to saddle-stitch a center-folded sheet bundle.

Figure 20:
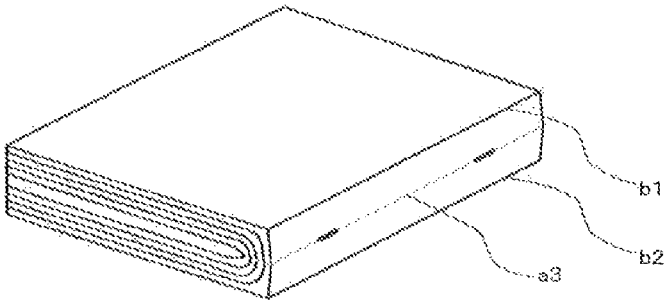
Fig.20 Prior Art
FIG. 20 is an illustration view illustrating a state of the conventional square back processing.

Incidentally, herein, whether to be the cover or not has been judged but a judgment may be made whether to be the cover and 1-2 sheets close to the cover or not, or whether to be other sheets or not. The reason is that in the case of thick paper, due to the influence of 1-2 sheets close to the cover, the case where a center folding trace is noticeable is produced as shown in FIG. 20. Herein, the number of sheets handled together with the cover is also preferably changed based on sheet thickness.

Further, when the type of folding is center folding and the cover is to be saddle-stitched with respect to executed image formation (YES at step S104 in FIG. 5), the control section 301 judges whether square back processing has been selected (step S105 in FIG. 5).

Herein, in the ease of a saddle-stitched cover, however, without square back processing (NO at step S105 in FIG. 5), the control section 301 provides ins actions on center folding normal control to the folding section 320, which, then, performs a normal center folding control operation to center-fold a sheet (step S108 in FIG. 5).

Further, with respect to executed image formation, in the case of a cover to be subjected to center folding and saddle stitching as well as square hack processing (YES at step S105 in FIG. 5), the control section 301 judges whether each sheet is subjected to center folding weak control to be described later (step S106 in FIG. 5).

Herein, in the case of a saddle-stitched cover to be subjected to square hack processing but not to center-folding weak control (NO at step S106 in FIG. 5), the control section 301 provides instructions on center folding normal control to the folding section 320, which, then, performs a normal center folding control operation (center folding normal control) to center-fold a sheet (step S108 in FIG. 5).

Herein, the center folding normal control, to be described later, refers to a center folding control to form a normal fold line. Further, the center folding weak control, to be described later, refers to a processing in which the nipping amount in the folding section 320 during center folding is changed to weaken a center-folded fold line to a larger extent than in the center folding normal control.

Further, the subject of the center folding weak control includes, other than the requirement for a cover with center folding/saddle stitching/square back processing as described above, a sheet such as thick paper or coated paper in which the influence of a fold line is liable to remain; and a cover sheet where an image is formed on the spine cover portion corresponding to the position of a center-folded fold line. In contrast, thin paper and a sheet being soft in which the influence of a fold line tends not to remain need only to be subjected to center folding normal control.

In the case of such a sheet corresponding to the subject of center folding weak control (YES at step S106 in FIG. 5), the control section 301 provides instructions on center folding weak control to the folding section 320, which, then, performs a center folding control operation so as to weaken a center-folded fold line more than normal (step S109 in FIG. 5).

Then, the control section 301 performs control operations as follows: with respect to a sheet bundle having been folded by the folding section 320 as described above, the saddle stitching section 340 is allowed to carry out saddle stitching by stapling if stitching has been selected and the square hack processing section 350 is allowed to carry out square back processing if square back processing has been selected; and a sheet bundle, in which needed post-processings inside the post-processing apparatus 300 have been completed, is discharged.

The center folding normal control will now be described with reference to the flowchart of FIG. 7 and the illustration views of FIGS. 8-10. Incidentally, in the folding section 320, a knife drive motor is arranged in the knife drive section 3251. Further, in the folding section 320, a folding roller drive motor to drive the folding roller 3242 via the drive roller 3243 is arranged.

Initially, for the start of center folding normal control, the control section 301 controls each section of the knife drive section 3251 of the folding section 301 in its initial state. Then, the control section 301 discriminates whether the home position (HP) sensor of the knife 3250 in the knife drive section 3251 has shown ON or OFF detection (step S201 in FIG. 7).

Figure 7:
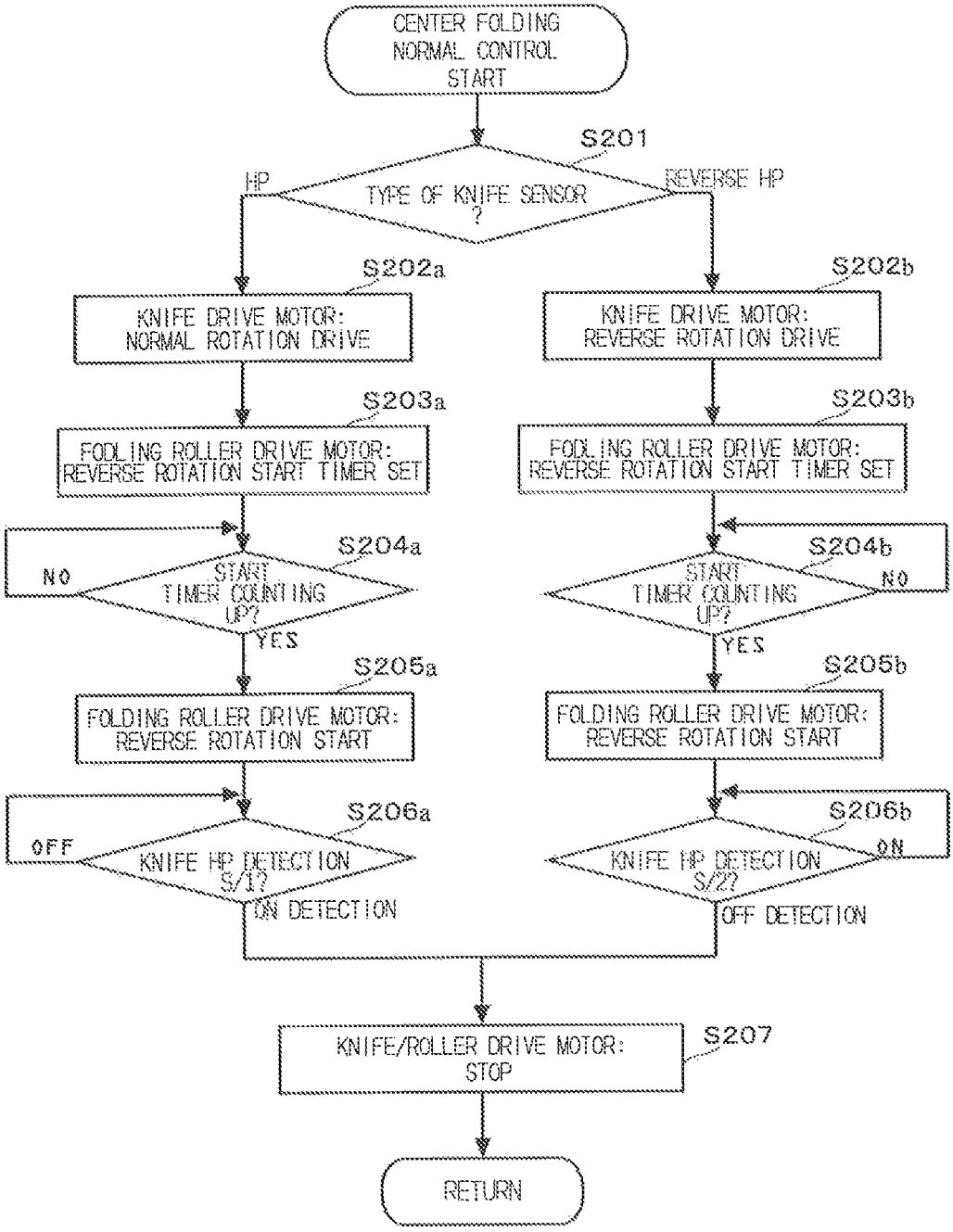
FIG. 7 is a flowchart showing operations of the post-processing apparatus of the embodiment of the present invention.
Figure 8:
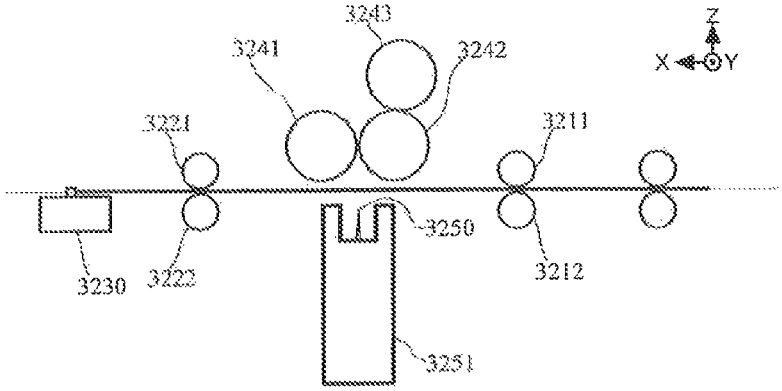
FIG. 8 is a constitutional view illustrating the configuration of the post-processing apparatus of the embodiment of the present invention.

In the state where a sheet having been conveyed from the image forming apparatus 100 has stopped while being regulated at a predetermined position by the front edge stopper 3230 (FIG. 8), the control section 301, in the case of ON detection by the HP sensor ("HP" at step S201 in FIG. 7), drives the knife drive motor in the knife drive section 3251 in the normal rotational direction for a certain time (step S202*a* in FIG. 7). In contrast, in the case of OFF detection of the HP sensor ("reverse HP" at step S201 in FIG. 7), the control section 301 drives the knife drive motor in the knife drive section 3251 in the reverse rotational direction for a certain time (step S202*b* in FIG. 7).

Figure 9:
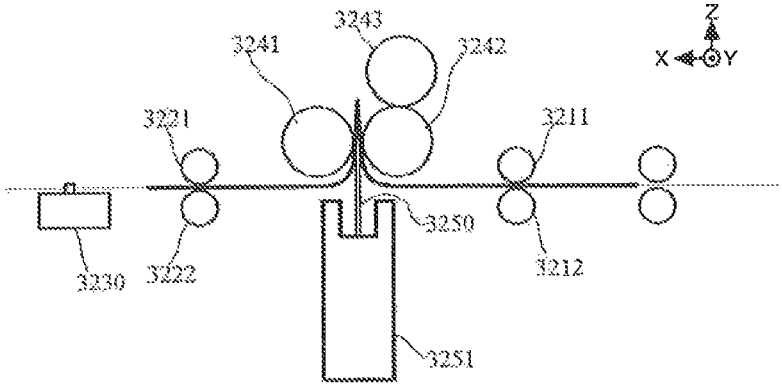
FIG. 9 is a constitutional view illustrating the configuration of the post-processing apparatus of the embodiment of the present invention.
Figure 1:
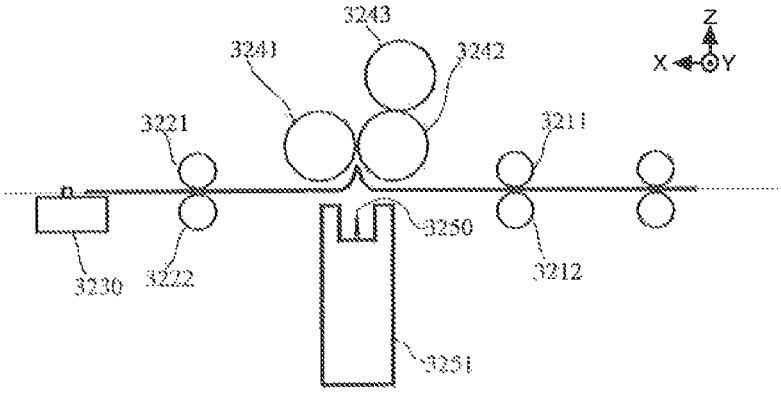

The drive of this knife drive motor for a certain time allows the knife 3250 to extend in the Z direction between the rotatable folding rollers 3241 and 3242 and then to stop, and thereby while a sheet is nipped between the folding rollers 3241 and 3242, a fold line is formed (FIG. 9).

At the time when the knife drive motor has stopped, the control section 301 sets the reverse rotation start timer of the folding roller drive motor (steps S203*a* and S203*b* in FIG. 7), and when the timer has counted up (YES at step S204*a* and YES at step S204*b* in FIG. 7), the folding roller drive motor rotates, via the drive roller 3243, the folding rollers 3241 and 3242 having been rotatable and free in the direction opposite to the direction up to that time (steps S205 and S205*b* in FIG. 7).

Further, in parallel therewith, the knife drive motor also drives the knife 3250 having extended in the Z direction so as to return to its initial position. Herein, the rotation of the folding roller 3242 in the reverse direction drives a sheet and the knife in the −Z direction. Then, when the HP sensor of the knife 3250 detects the retraction of the knife (steps S206*a* and S206*b* in FIG. 7), the knife drive motor and the folding roller drive motor stop driving (step S207 in FIG. 7).

Thereby, in the fold line portion, the nipping of the folding rollers 3241 and 3242 is released, and as shown in FIG. 10, the sheet is allowed to be in the state where a fold line has been firmly formed. Incidentally, thereafter, as shown in FIG. 2, the sheet is conveyed in the Y direction toward the stacking section 330 and the saddle stitching section 340.

The center folding weak control will now be described with reference to the flowchart of FIG. 11, the time charts of FIGS. 12 and 13, and the illustration views of FIGS. 14-17.

Herein, the time chart of FIG. 12 shows the state where in step S301 of the flowchart of FIG. 11, the detection result is "HP" to be described later. Region (a) in FIG. 12 shows ON/OFF of the drive motor; region (b) in FIG. 12 and region (c) in FIG. 12 show HP sensor detection results of the knife 3250; and region (d) in FIG. 12 shows ON/OFF of the folding roller drive motor. Herein, region (a) in FIG. 12 and region (b) in FIG. 12 show detection results of two HP sensors differently located to determine the position of the knife 3250.

Herein, the time chart of FIG. 13 shows the state where in step S301 of the flowchart of FIG. 11, the detection result is "reverse HP" to be described later. Region (a) in FIG. 13 shows ON/OFF of the knife drive motor; region (b) in FIG. 13 and region (c) in FIG. 13 show HP sensor detection results of the knife 3250; and region (d) in FIG. 13 shows ON/OFF of the folding roller drive motor. Herein, region (a) in FIG. 13 and region (b) in FIG. 13 show detection results of two HP sensors differently located to determine the position of the knife 3250.

Initially, for the start of center folding weak control, the control section 301 controls each section of the knife drive section 3251 of the folding section 320 in its initial state. Then, the control section 301 discriminates whether the HP sensor of the knife 3250 in the knife chive section 3251 has shown ON or OFF detection (step S301 in FIG. 11).

Figure 11:
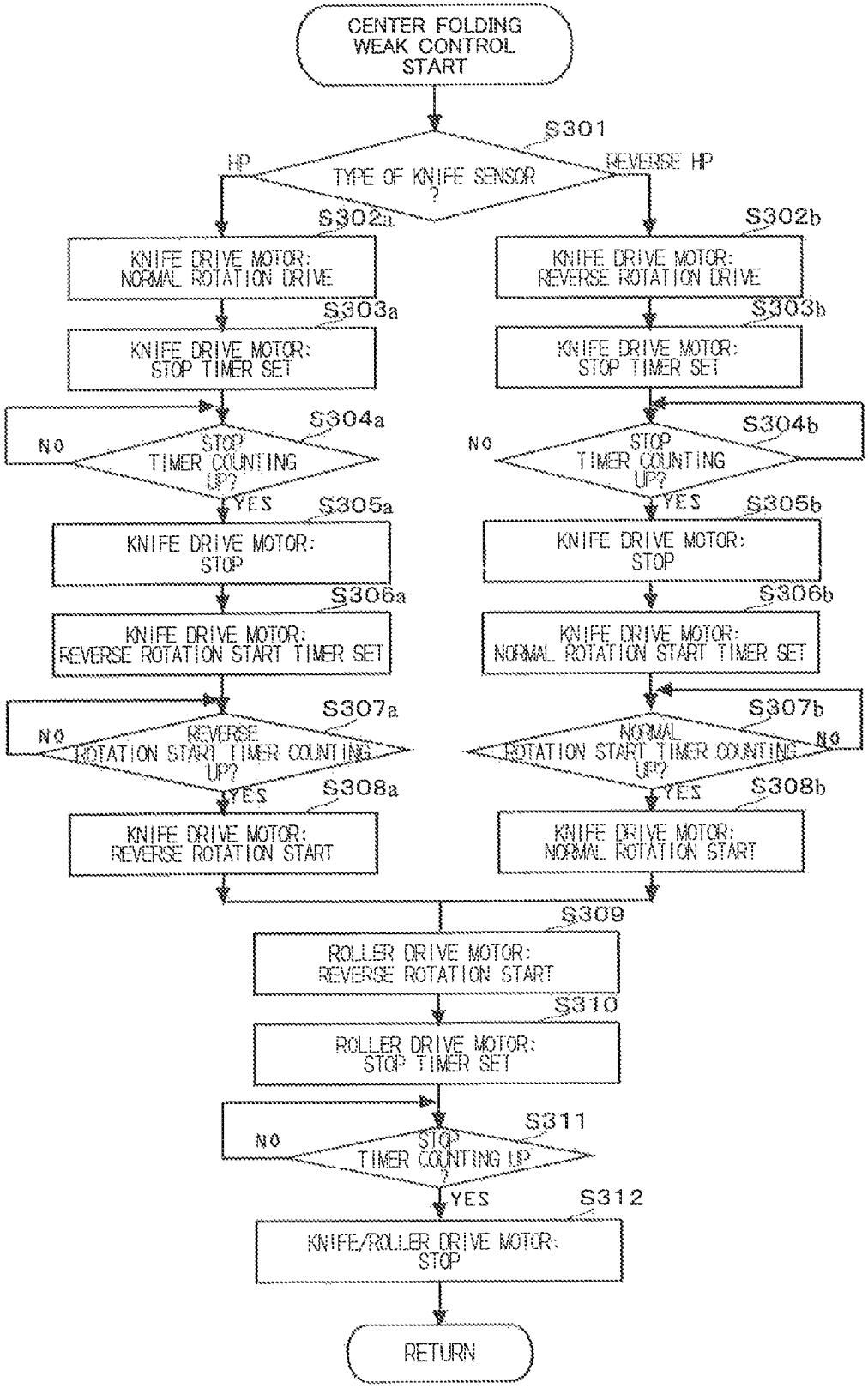
FIG. 11 is a flowchart showing operations of the post-processing apparatus of the embodiment of the present invention.
Figure 1:
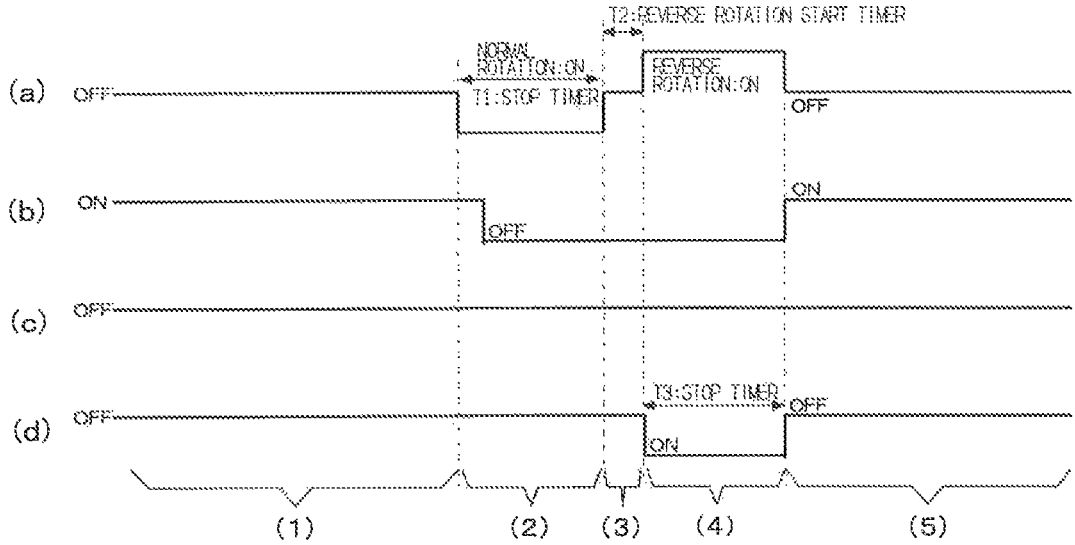
Figure 1:
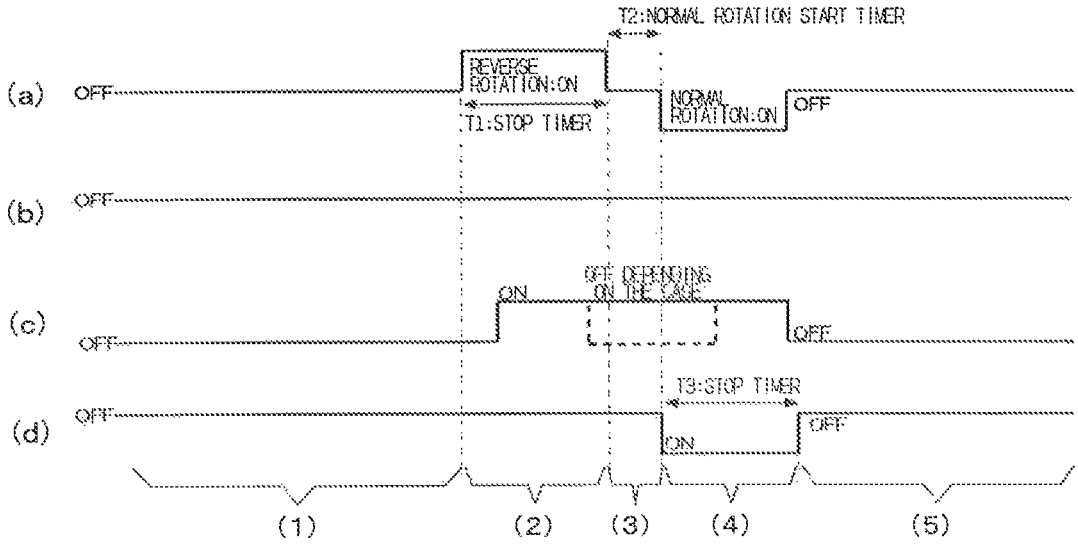
Figure 1:
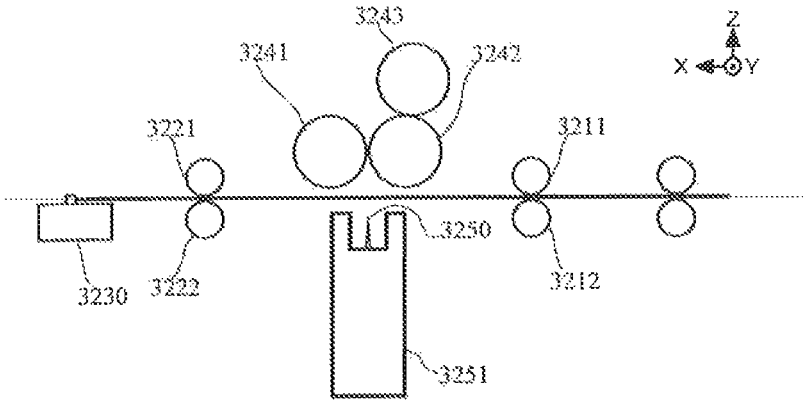
Figure 1:
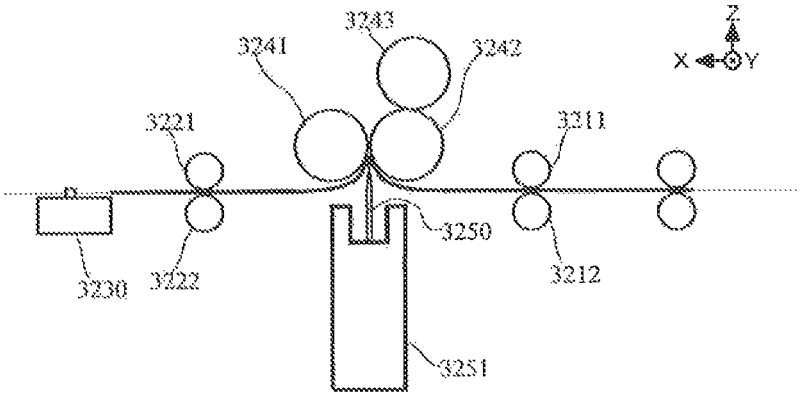
Figure 1:
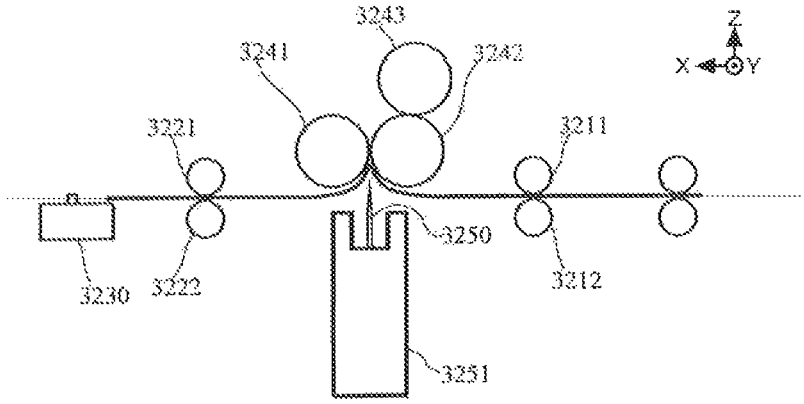
Figure 1:
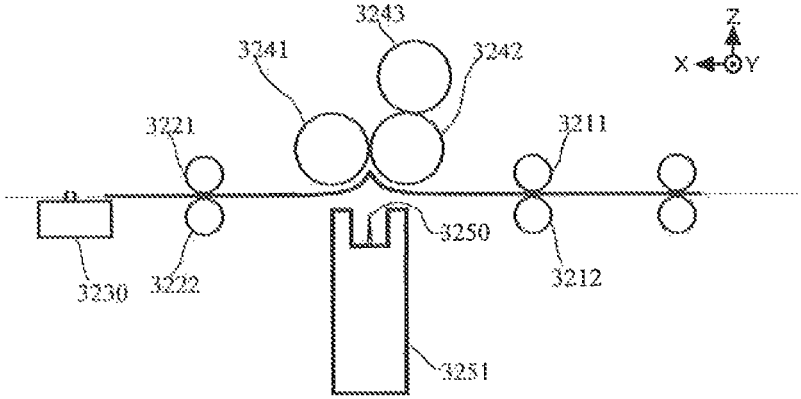
Figure 1:
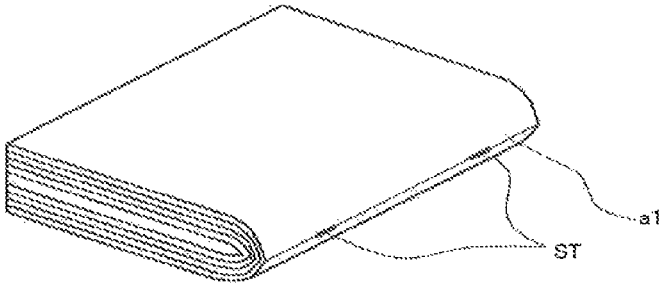
Fig. 1 8 Prior Art
Figure 1:
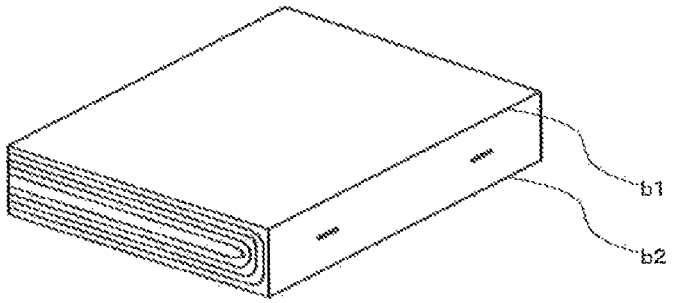
Fig. 1 9 Prior Art

In the state where a sheet having been conveyed from the image forming apparatus 100 has stopped while being regulated at a predetermined position by the front edge stopper 3230 (state (1) in FIG. 12, state (1) in FIG. 13, and FIG. 14), the control section 301, in the case of ON detection by the HP sensor ("HP" at step S301 in FIG. 11), drives the knife drive motor in the knife drive section 3251 in the normal rotational direction by a certain time T1 to drive the knife 3250 in the Z direction (extending direction) (steps S302*a* and 303*a* in FIG. 11 and state (2) in FIG. 12).

In contrast, in the case of OFF detection of the HP sensor ("reverse HP" at step S301 in FIG. 11), the control section 301 drives the knife drive motor in the knife drive section 3251 in the reverse rotational direction by a certain time T1 to drive the knife 3250 in the Z direction (extending direction) (steps S302*b* and S303*b* in FIG. 11 and state (2) in FIG. 13).

Herein, as the time T1 to drive the knife drive motor, it is preferable to set a time required to extend the knife 3250 up to the position before passing through the nipping position of the folding rollers 3241 and 3242. That is, in the center folding weak control, a control operation is carried out so that the nipping amount between the folding rollers 3241 and 3242 is allowed to be smaller than that in the center folding normal control.

When the certain time T1 to drive the knife drive motor has elapsed, the control section 301 sets, using the timer, the time T2 until the knife drive section 3251 starts driving reversely until then (steps S306*a* and S306*b* in FIG. 11) to wait until the time T2 elapses (steps S307*a* and 307*b* in FIG. 11, state (3) in FIG. 12, state (3) in FIG. 13, and FIG. 15). That is, the drive of the knife drive motor for the certain time T1 stops the tip of the knife 3250 in the vicinity between the rotatable folding rollers 3241 and 3242, and thereby, while a sheet is lightly nipped between the folding rollers 3241 and 3242 or in contact therewith, a fold line is loosely formed (FIG. 15).

When the stat timer 12 has counted up (YES at step S307*a* and YES at step S307*b* in FIG. 11), the knife drive motor drives the knife 3250 having extended in the Z direction in the −Z direction so as to return to its initial position (steps S308*a* and S308*b* in FIG. 11). In parallel therewith, the folding roller drive motor rotates, via the drive roller 3243, the folding roller 3242 having been rotatable and free in the direction opposite to the direction up to that time by a certain time T3 (steps S309 in FIG. 11, state (4) in FIG. 12, state (4) in FIG. 13, and FIG. 16).

Then, when the home position sensor of the knife 3250 detects the retraction of the knife, the knife drive motor stops driving. Further, when the timer has counted up to the time T3 (stepS310 and YES at step S311 in FIG. 11), the folding roller drive motor stops driving (step S312 in FIG. 11 and FIG. 17).

Thereby, formation of a fold line portion using the folding rollers 3241 and 3242 and the knife 3250 is terminated, and as shown in FIG. 17, a state where a loose fold line is formed compared with FIG. 10 is realized. Incidentally, thereafter, as shown in FIG. 2, the sheet is conveyed in the Y direction toward the stacking section 330 and the saddle stitching section 340.

As describe above, when a control operation is carried out to reduce the nipping amount between the folding rollers 3241 and 3242 and the insertion amount of the knife 3250 in order to form a looser fold line than normal, a state where a center folding trace during saddle stitching tends not to remain in the spine cover portion is realized, and thereby square back processing can be carried out without generation of any center folding trace in the spine cover portion of a booklet.

In addition, as described above, since a fold line, which is, however, looser than normal, is formed, no position misalignment will occur in conveyance from the folding section 320 to the stacking section 330 and the saddle stitching section 340 and in positioning in the stacking section 330 and the saddle stitching section 340.

In the above embodiment, in cases in which square back processing is carried out to flatten the spine folded portion of a sheet bundle in which a fold line for saddle stitching is formed, the nipping amount in the folding section 320 is controlled so as to be small than in the case of no square back processing. Thereby, while stitching position accuracy is maintained in conveyance from the folding section 320 to the saddle stitching section 340 and in positioning in the saddle stitching section 340, a state where in the spine cover portion, a center folding trace during saddle stitching tends not to remain is realized, and thereby square back processing can be carried out without generation of any center folding trace in the spine cover portion of a booklet.

Further, when with insertion of the knife from the rear (valley) of a portion of a sheet where a fold line will be formed, the sheet is nipped by 2 rollers, the insertion amount of the knife is decreased at the time of square back processing, whereby the nipping amount in the folding section 320 can be accurately controlled. Thereby, while stitching position accuracy is maintained, a state where in the spine cover portion, a center folding trace during saddle stitching tends not to remain is realized, and thereby square back processing can be carried out without generation of any center folding trace in the spine cover portion of a booklet.

Further, with respect to at least a sheet to serve as the cover in a sheet bundle to be subjected to square back processing, a control operation is carried out to change the nipping amount in the folding section 320, and thereby a state where in the spine cover portion, a center folding trace during saddle stitching tends not to remain is realized, whereby square back processing can be carried out without generation of any center folding trace in the spine cover portion of a booklet.

Further, at the time of square back processing, there is made a determination whether a control operation is carried out to change the nipping amount in the folding section 320 based on the type of sheet. Herein, in a sheet such as thick paper or coated paper, as a type of sheet, in which the influence of a fold line tends to remain, a control operation is carried out to reduce the nipping amount in the folding section. As a result, a state where in the spine cover portion, a center folding trace during saddle stitching tends not to remain is realized. Whereby square back processing be carried out without generation of any center folding trace in the spine cover portion of a booklet.

Furthermore, at the time of square bath processing, there is made a determination whether a control operation is carried out to change the nipping amount in the folding section 320 depending on formation or no formation of an image on a spine cover portion to be flattened in a sheet to serve as a cover. Herein, when an image is formed on the spine cover portion to be flattened via square back processing, a control operation is carried out to reduce the nipping amount in the folding section. Thereby, without generation of any trace due to image degradation caused by the influence of center folding in a portion of an image of the spine cover, square back processing can be carried out.

Other Embodiments

In the above embodiment, in an image forming system in which a sheet with a formed image thereon is conveyed in the X direction, a sheet to be subjects to center folding and saddle stitching is conveyed in the Y direction, which, however, by no means limits the scope of the present invention. A sheet to be subjected to center folding and saddle stitching may be conveyed in the X direction or in any direction between the X and Y directions.

In addition, in the above embodiment, two types of control, which are center folding normal control and center folding weak control, have been employed. However, it is possible that the nipping amount in the knife and the folding rollers is controlled in a plurality of stages and the center folding weak control is divided into a plurality of stages.

The present U.S. patent application claims a priority under the Paris Convention of Japanese patent application No. 2011-254716 filed on Nov. 22, 2011, which shall be a basis of correction of an incorrect translation.

What is claimed is:

1. A post-processing apparatus which performs post-processing of a sheet where an image is formed, the post-processing apparatus comprising:

a folding sector configured to nip a sheet using a plurality of rollers to form a fold line for saddle stitching while inserting a knife into a portion of the sheet; and a control section configured to control the nipping amount in the folding section so that the nipping amount in the case where square back processing to flatten a spine folded portion of a sheet bundle on which a fold line for saddle stitching is formed is performed is smaller than the nipping amount in the folding section in the case where the square back processing is not performed by making the insertion amount of the knife in the case where the square back processing is performed smaller than the insertion amount of the knife in the case where the square back processing is not performed.

2. The post-processing apparatus of claim 1, wherein the folding section nips the sheet while inserting the knife from the rear of a portion where a fold line is formed, and the control section changes the insertion amount of the knife so as to control the nipping amount in the folding section depending on whether the square back processing is performed or not.

3. The post-processing apparatus of claim 1, wherein the control section performs a control operation to change the nipping amount in the folding section with respect to at least a sheet to serve as the cover in a sheet bundle to be subjected to square back processing.

4. The post-processing apparatus of claim 1, wherein the control section determines whether a control operation to change the nipping amount in the folding section is performed based on the type of the sheet when the square back processing is performed.

5. The post-processing apparatus of claim 1, wherein the control section determines whether a control operation to change the nipping amount in the folding section is performed depending on whether an image is formed on a spine cover portion to be flattened in a sheet to serve as a cover when the square back processing is performed.

6. The post-processing apparatus of claim 1, wherein the folding section forms the fold line for the saddle stitching for each sheet.

7. The post-processing apparatus of claim 1, wherein the control section determines whether the control operation to change the nipping amount in the folding section is performed or not, based on a setting of a cover sheet.

8. The post-processing apparatus of claim 1, wherein the control section performs the control operation to change the nipping amount in the folding section, with respect to only a sheet to serve as the cover in a sheet bundle to be subjected to square back processing.

9. The post-processing apparatus of claim 1, wherein the control section judges whether each sheet is subjected to the square back processing or not and determines for each sheet whether the control operation to change the nipping amount in the folding section is performed or not, based on the results of the judgments.

10. A post-processing method, in which using a post-processing apparatus including a folding section configured to nip a sheet using a plurality of rollers to form a fold line for saddle stitching while inserting a knife into a portion of the sheet, the post processing method comprising the step of:

setting the insertion amount in the folding section to be a first amount for insertion of the knife in the case where the square back processing to flatten a spine folded portion of a sheet bundle on which a fold line for saddle stitching is formed is not performed;

setting the insertion amount in the folding section to be a second amount which is smaller than the first amount for insertion of the knife in the case where square back processing is performed;

receiving information related to whether square back processing is performed or not;

judging whether or not to perform square back processing based on the received information; and inserting the knife with the second amount, when square back processing is performed.

11. The post-processing method of claim 10 further comprising the steps of:

nipping the sheet while the knife is inserted from the rear of a portion where a fold line of the sheet is performed and controlling the nipping amount in the folding section depending on whether the square back processing is performed.

12. The post-processing method of claim 10 further comprising the step of:

changing the nipping amount in the folding section with respect to at least a sheet to serve as the cover in a sheet bundle to be subjected to square back processing.

13. The post-processing method of claim 10 further comprising the step of:

determining whether the nipping amount in the folding section is to be changed based on the type of the sheet in the square back processing.

14. The post-processing method of claim 10 further comprising the step of:

determining whether the nipping amount in the folding section is to be changed depending on whether an image is formed on a spine cover portion to be flattened in a sheet to serve as a cover when the square back processing is performed.

15. The post-processing method of claim 10, wherein the folding section forms the fold line for the saddle stitching for each sheet by the folding section.

16. The post-processing method of claim 10 further comprising the step of:

determining whether the control operation to change the nipping amount in the folding section is performed or not, based on a setting of a cover sheet.

17. The post-processing method of claim 10, wherein the control operation to change the nipping amount in the folding section is performed, with respect to only a sheet to serve as the cover in a sheet bundle to be subjected to square back processing.

18. A post-processing apparatus which performs post-processing of a sheet where an image is formed, the post-processing apparatus comprising:

a folding section configured to nip a sheet using a plurality of rollers to form a fold line for saddle stitching; and a control section configured to control the nipping amount in the folding section with respect to at least a sheet to serve as the cover in a sheet bundle to be subjected to square back processing so that the nipping amount in the folding section in the case where square back processing to flatten a spine folded portion of a sheet bundle on which a fold line for saddle stitching is formed is performed is smaller than the nipping amount in the folding section in the case where the square back processing is not performed.

19. A post-processing apparatus which performs post-processing of a sheet where an image is formed, the post-processing apparatus comprising:

a folding section configured to nip a sheet using a plurality of rollers to form a fold line for saddle stitching; and a control section configured to control the nipping amount in the folding section so that the nipping amount in the folding section in the case where square back processing to flatten a spine folded portion of a sheet bundle an which a fold line for saddle stitching is formed is performed is smaller than the nipping amount in the folding section in the case where the square back processing is not performed, depending on whether an image is formed on a spine cover portion to be flattened in a sheet to serve as a cover when the square hack processing is performed.

20. A post-processing method, comprising the steps of:

nipping a sheet where an image is formed by a folding section of a post processing apparatus using a plurality of rollers to form a fold line for saddle stitching, controlling by a control section the nipping amount in the folding section with respect to at least a sheet to serve as the cover in a sheet bundle to be subjected to square back processing so that the nipping amount in the folding section in the case where square back processing to flatten a spine folded portion of a sheet bundle on which a fold line for saddle stitching is formed is performed is smaller than the nipping amount in the folding section in the case where the square back processing is not performed.

* * * * *